United States Patent [19]

Hammond, Jr. et al.

[11] 3,958,416

[45] May 25, 1976

[54] COMBUSTION APPARATUS

[75] Inventors: Dean C. Hammond, Jr., Warren, Mich.; Ronald E. Quinn, Indianapolis, Ind.

[73] Assignee: General Motors Corporation, Detroit, Mich.

[22] Filed: Dec. 12, 1974

[21] Appl. No.: 531,873

[52] U.S. Cl. ..... 60/39.65; 60/39.71; 60/39.74 R; 239/406; 239/417.3

[51] Int. Cl.[2] ..... F02C 7/22; F02M 23/08

[58] Field of Search ..... 60/39.71, 39.74 R, 39.74 B, 60/39.65; 239/405, 406, 417.3

[56] References Cited

UNITED STATES PATENTS

| | | | |
|---|---|---|---|
| 3,310,240 | 3/1967 | Grundman | 239/406 |
| 3,349,826 | 10/1967 | Poole et al. | 239/406 |
| 3,361,182 | 1/1968 | Pillard | 239/406 |
| 3,498,059 | 3/1970 | Gradon et al. | 60/39.74 B |
| 3,600,891 | 8/1971 | Gordon | 60/39.74 R |
| 3,605,405 | 9/1971 | Du Bell | 60/39.74 R |
| 3,768,250 | 10/1973 | Kawaguchi | 239/406 |
| 3,853,273 | 12/1974 | Bahr et al. | 60/39.74 R |
| 3,859,787 | 1/1975 | Anderson et al. | 60/39.71 |

FOREIGN PATENTS OR APPLICATIONS

| | | | |
|---|---|---|---|
| 843,641 | 8/1960 | United Kingdom | 239/406 |
| 215,053 | 5/1961 | Austria | 239/406 |

*Primary Examiner*—William L. Freeh
*Assistant Examiner*—Robert E. Garrett
*Attorney, Agent, or Firm*—Paul Fitzpatrick

[57] ABSTRACT

A combustion liner for a gas turbine combustion apparatus has a wall of circular cross-section defining a primary air entrance at its upstream end, providing means for introduction of fuel near the upstream end, having a convergent-divergent fuel prevaporization zone, a reaction zone, and a dilution zone.

The primary air entrance has two coaxial entrance portions separated by an annular intermediate wall disposed around a centerbody. Swirlers in the two entrance portions swirl the air with different degrees of swirl, which provides shear between the two layers downstream of the swirlers. Fuel is introduced onto the intermediate or outer wall, or both, upstream of the throat. Air is admitted through the centerbody and directed towards the throat at higher fuel flow rates, but is shut off by a valve plug at low fuel flow rates to promote recirculation and thus improve flame stability under such conditions. The valve responds to fuel and combustion air pressure. A pilot fuel nozzle is mounted on the valve plug in the centerbody outlet.

Recirculation from the dilution zone into the reaction zone is controlled by an annular barrier extending inwardly from the liner wall between the two zones. Air is circulated through the barrier adjacent the walls of the barrier to cool it. Means are provided for varying the primary and secondary air flow areas.

4 Claims, 4 Drawing Figures

COMBUSTION APPARATUS

This invention relates to combustion apparatus of a type used in gas turbine engines. Particularly, it relates to a combustion liner for such apparatus. The invention involves improved arrangements for introduction, dispersion, and evaporation of fuel in primary air entering the liner; improved arrangements for stabilizing combustion in the liner, barrier means for segregating the dilution zone of the liner from the reaction zone, and an arrangement for cooling the barrier between the reaction and dilution zones.

The principal object of the improved structure according to the invention is to provide a combustion apparatus having exceptionally clean and stable combustion over a wide range of operating levels in a gas turbine engine. Other objects are to improve the distribution and evaporation of fuel in such combustion apparatus, to provide variable air inlet means which acts to minimize recirculation into the fuel vaporization zone during normal operation but is disabled during idling or low fuel flow operation to allow recirculation to promote stability of combustion. A further object is to provide cooled structure of a barrier wall extending inwardly into a combustion liner in a position to be highly heated by combustion gases within the apparatus.

Other objects and advantages of the invention will be apparent to those skilled in the art from the succeeding detailed description of the preferred embodiment, the accompanying drawings thereof, and the appended claims.

Referring to the drawings.

The invention preferably, although not necessarily, is employed in a regenerative gas turbine engine such as those described in U.S. Pat. Nos. 3,077,074, Feb. 12, 1963, and 3,267,674, Aug. 21, 1966, to Collman et al. Since details of engine structure are immaterial to the invention, the engine is illustrated only fragmentarily.

Figure 1:
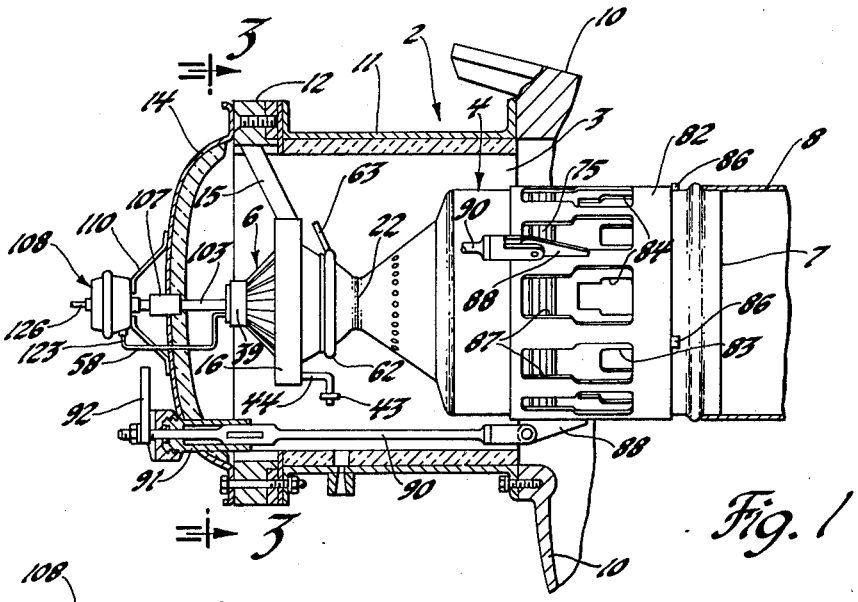
FIG. 1 is a small scale view of a combustion liner according to the invention in place in a gas turbine engine, the engine being shown fragmentarily in section.

As illustrated in FIG. 1, the engine includes a frame or housing 2 defining a space or conduit 3 which receives compressed air from the compressor of the engine (not illustrated). A combustion liner 4 mounted in the space 3 is defined by walls of preferably circular cross-section extending from an upstream end at 6 to a downstream outlet end 7. Fuel is introduced near the upstream end of the liner, is mixed with primary air entering the liner through suitable entrances from the space 3, and is evaporated. The resulting mixture is burned, and the combustion products are discharged from the outlet end of the liner into a duct 8 leading to a turbine of the engine (not illustrated).

Considering the installation of the liner more fully, the engine frame 2 includes a main engine housing 10, a generally cylindrical extension 11 disposed around the upstream portion of the liner; a support ring 12, and a combustion section cover 14. The extension 11 and cover 14 have heat insulating material on their inner surfaces. The cover and support ring are bolted to the extension 11 and the latter is bolted to the main housing 10.

The upstream end of the combustion liner is supported from the support ring 12 by struts 15 which are fixed to an L-section flange 16 (see also FIG. 4) extending around and fixed to the wall of the combustion liner. The downstream end of the liner is supported by the duct 8.

Figure 3:
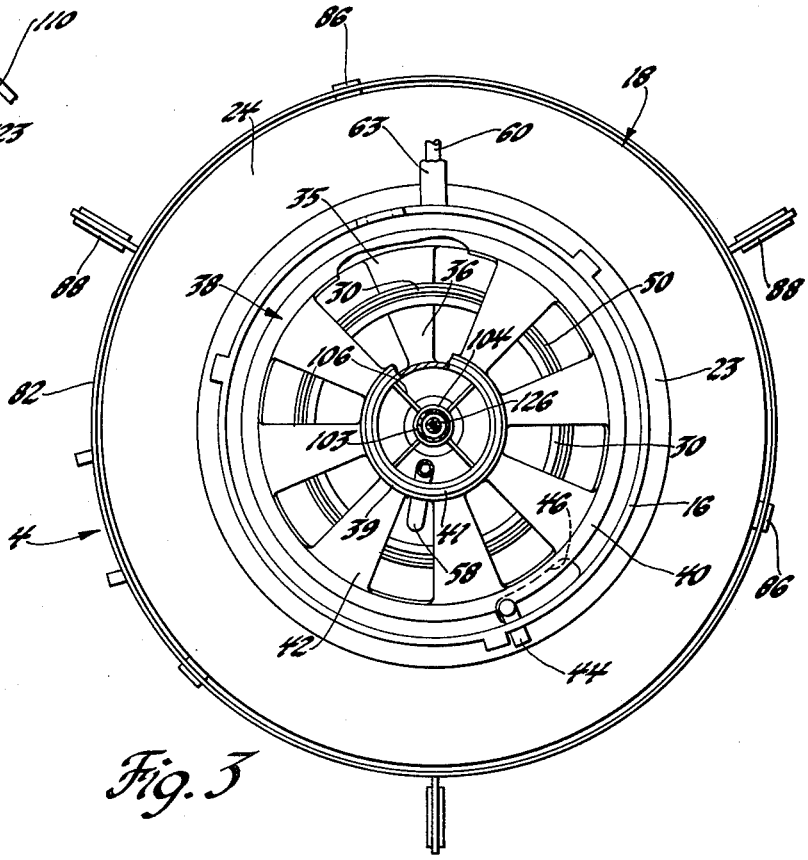
FIG. 3 is an upstream end elevation view of the combustion liner taken on the plane indicated by the line 3—3 in FIG. 1.
Figure 4:
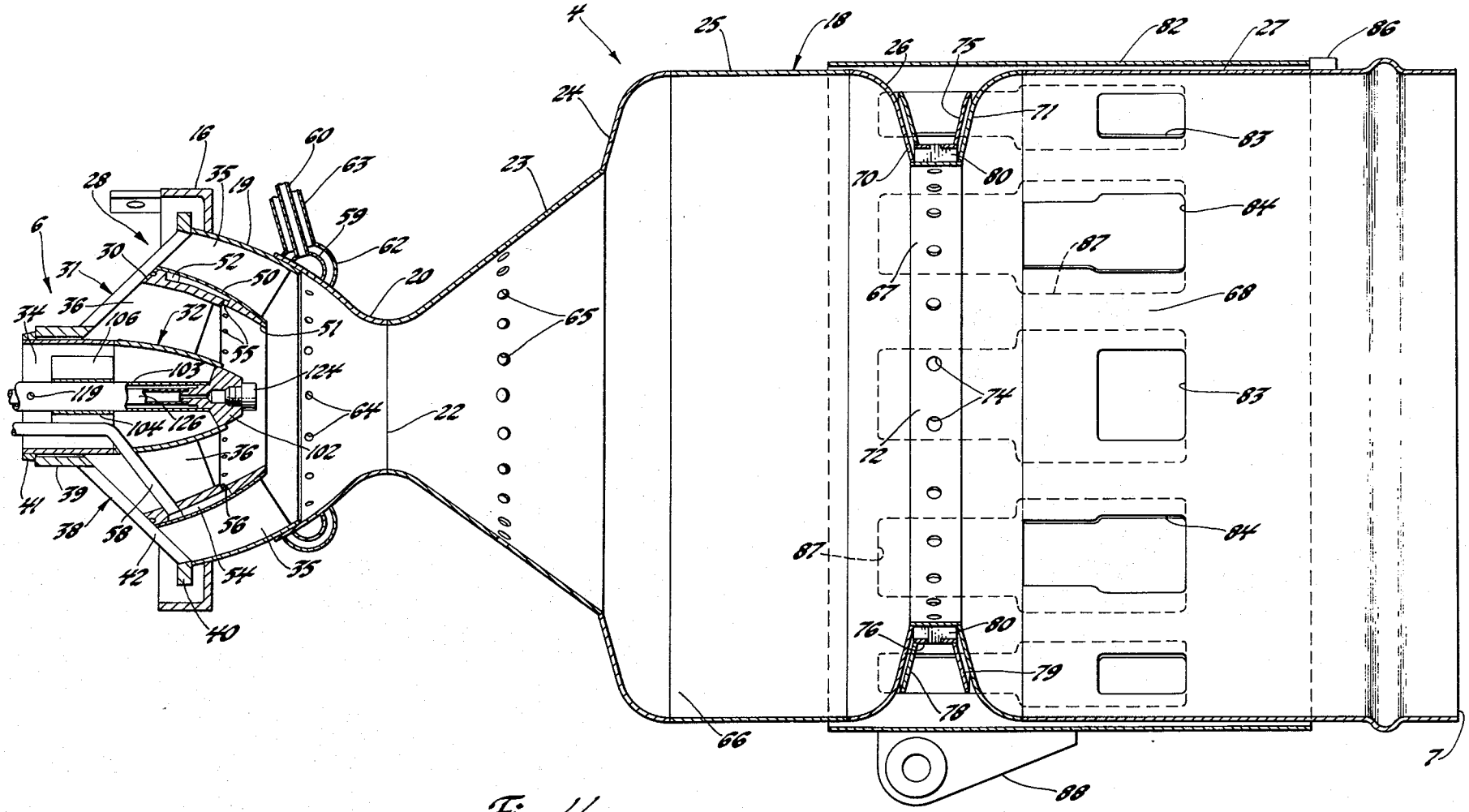
FIG. 4 is a longitudinal sectional view of the combustion liner.

Referring now to FIGS. 3 and 4 for more details of the preferred liner surface, the liner 4 includes wall means 18 extending from within the flange 16 to the outlet 7. The initial section of this wall means is a converging sheet metal ring 19 welded to ring 16. This ring is welded or brazed to a second converging ring 20 which overlaps the first and terminates at a throat or minimum diameter portion 22. A diverging wall ring 23 welded to ring 20 extends downstream from the throat to a flare ring 24 which flares abruptly to the maximum diameter of the liner. Ring 24 is welded at its ends to ring 23 and to a cylindrical ring 25. Ring 25 is welded at its downstream end to a barrier ring weldment 26 which defines a flange or barrier extending into the liner around its entire circumference. The downstream edge of weldment 26 is welded to a cylindrical downstream liner ring 27 which extends to the outlet 7.

As will be explained more fully, the upstream end of the liner walls includes means for admission of primary (combustion) air and of fuel. The fuel is mixed and evaporated largely in the area adjacent throat 22. The reaction or combustion zone extends from about the middle of the length of ring 23 to the barrier ring 26. The dilution zone of the liner, in which additional air is mixed with the combustion products to lower their temperature, is defined downstream of barrier 26 within the ring 27.

Returning to the upstream end of the liner and the means for introducing fuel, the converging ring 19 which forms part of the outer wall of the liner defines the outer boundary of an outer air inlet 28. This air inlet lies between the wall 19 and an intermediate converging wall 30. An intermediate air inlet 31 is defined between the wall 30 and a centerbody 32 coaxial with the outer and intermediate walls. An inner air inlet 34 extends through the centerbody, as will be further explained.

The outer and intermediate walls are interconnected by an annular cascade of swirl vanes 35 and the intermediate wall is connected to the centerbody by a similar cascade 36. The ends of the vanes may be brazed to the structures between which they extend. These vanes have a blunt forward edge, as shown more clearly in FIG. 3. The cross-section of a vane of either cascade is defined by a substantially straight line transverse to the liner axis at the forward end and by two approximately circular arcs which converge downstream and intersect to provide a sharp trailing edge for the vane. The passages between the vanes are of roughly constant area. The flat leading edges of these vanes cooperate with a primary air flow throttling arrangement provided by a valve member 38 rotatably mounted on the exterior of the centerbody 32 by a hub portion 39 and retained by a ring 41. The outer margin of the valve member is defined by a rim 40 which bears against the forward edge of the wall ring 19.

There are eight vanes in each of the sets 35 and 36, and correspondingly eight air entrance passages in each set, in the specific embodiment. These passages are throttled by rotation of the valve member 38, it being shown in the wide open position in FIG. 3. The valve member includes eight spokes 42 which overlie the leading edges of the vanes in the position shown in FIG. 3. Rotation of the valve member about its axis causes the spokes 42 to obstruct to a variable extent the primary air entrance openings through the two swirlers to control the flow or primary air. The valve member 38 is rotated by a link 43 (FIG. 1) connected to a bent arm 44 welded to the valve ring and reciprocable in a slot 46 in the flange 16.

The intermediate wall 30 is composed of an outer sheet metal ring or cover 50 and an inner cast or machined ring 51. The latter has a circumferential fuel manifold 52 in its outer surface which is connected by axially extending grooves 54 to a ring of fuel ports 55 in the inner surface of the ring. The two rings 50 and 52 are brazed together so that the structure is fluid-tight except for the fuel ports, which are essentially tangent to the inner surface of the ring so as to lay the fuel on the surface for atomization by the air blast flowing through the intermediate air inlet 31. Ports 55 are disposed downstream of a shoulder or step 56 on the inner surface of the wall. Fuel is supplied to the manifold 52 and thence to the ports 55 through a fuel tube 58 which extends outside the combustion chamber cover and is connected to a suitable source of supply, the details of which are immaterial.

The swirlers defined by vanes 35 and 36 are of different pitch so that the tangential components of velocity of the air streams flowing off the trailing edge of the intermediate wall 30 are different, the outer swirler creating the higher degree of swirl. This causes a measure of shear and turbulence in the air, aiding in mixing and atomization of the fuel.

Fuel may also be introduced into the combustion apparatus by a manifold extending around the outer wall ring 20 for evaporation into the air flowing along the inner surface of that ring from inlet 28. In this case, a fuel manifold 59 extending around the circumference of the ring 20 just downstream of ring 19 is supplied with fuel through a tube 60. Since this manifold is in a rather hot area, it is desirable that it be cooled by air flowing circumferentially of the wall 20 through a jacket 62 overlying the manifold 59. Air may be introduced to this jacket through an air tube 63, flow substantially 360° around the manifold, and be exhausted through an opening at the end of the jacket 62. Fuel flows from the manifold 59 through a ring of small tangential fuel ports 64 extending through the wall 20 immediately downstream of wall 19, which provides a step or shoulder just ahead of the point of introduction of this fuel.

We prefer to refer to the fuel injection means into the intermediate air inlet 31 as an air-blast injector and to that introducing fuel from manifold 59 as a wall-film injector. Either type or both may be used, but it is preferred that the air-blast injector be used alone or in combination with the wall-film injector.

As previously stated, there is a third air inlet, the inner air inlet 34 which supplies primary air through the centerbody 32. However, this will be passed over for the present.

In normal operation, the mixture of fuel and air, with the fuel evaporating into the air to form a mixture of gaseous fuel and air, tends, because of the swirl, to follow the walls 20 and 23, expanding along the wall as it enters the diverging part of the downstream of throat 22. A row of small air holes 65 extends around the diverging section 23 about midway of its length. Specifically, in the instant case there are twenty-four holes and about 3 millimeter diameter. These inject a small amount of additional primary air normally to the swirling air in this diverging section of the liner. This has been shown experimentally to have a quite beneficial effect on mixing the partially stratified mixture emerging from the throat 22. Air flowing through these holes also prevents propagation of the flame through the more or less stagnant wall boundary layer of the diverging section and thus into the upstream droplet zone. These mixing holes also set up a turbulent shear layer which tends to act as an aerodynamic flame-holder. As a result, the flame front lies downstream of the holes 65 and combustion is completed in the terminal part of the diverging portion 23 and within remainder of the reaction zone 66 defined by wall sections 24, 25, and 26. The abruptly diverging wall 24 is used to dump the swirling primary flow in the main reaction zone. This sudden expansion, in addition to providing stabilization of flow separation from the diverging wall 23, also provides locations for the formation of secondary vortices which can serve to protect the main reaction flow from the cooling and quenching effect of the reaction zone liner walls 24, 25, and 26.

Due to the swirl the air entering the reaction zone, there is a toroidal vortex set up, with recirculation forwardly of the liner along the axis. It is highly desirable to control this recirculation to prevent the flame from striking back into the fuel injection portion of the apparatus under normal operation, and also to allow some recirculation to assist in maintaining combustion at low fuel flow rates such as during deceleration of the engine. To achieve this result, a nonswirling flow of air is introduced through the centerbody air inlet 34 under normal operation of the combustor, but is shut off during engine deceleration. This flow, which is nonswirling and is directed along the axis of the liner through the centerbody 32, acts to oppose any upstream recirculation flow along the liner axis and to drive the point of greatest penetration of the return flow farther downstream in the liner.

The reaction zone ends at the barrier ring 26, which provides a clear demarcation between the reaction and dilution zones, assist in guiding the recirculation in the reaction zone, and defines a restriction or orifice at 67 through which the gases flow from the reaction zone 66 into the dilution zone 68.

The barrier ring 26 is a structure welded of a number of parts, including a forward wall 70 and a rearward wall 71. These converge towards the axis of the liner as shown, penetrating about 15% of the liner diameter, so that the restriction 67 is about 70% of the diameter of the liner and thus about half the cross-sectional area of the liner rings 25 and 27. The inner edges of the walls 70 and 71 are joined by a cylindrical ring 72 which bounds the orifice 67. Ring 72 may be welded to the rings 70 and 71. The barrier structure is cooled by air which flows radially through the barrier into the orifice 67. The inner ring 72 in the particular instance has twenty-four 3 millimeter holes 74 through it. Air entering between the outer surfaces of walls 70, 71 is discharged through the holes 74 into the interior of the liner. To cause this flow to be most effective in cooling; that is, to cause it to scour more vigorously the outer surfaces of the walls 70 and 71, an annular baffle 75 lies between the closely adjacent to the outer surfaces of these walls.

The baffle 75 comprises an inner ring 76, a forward liner ring 78, and a rearward ring 79 extending parallel to and slightly spaced from the parts 72, 70, and 71, respectively. These are suitably welded together and are united to the ring 72 by circumferentially distributed support plates 80. The baffle and supports 80 are welded to the ring 72 before it is welded to one of the rings 70 and 71. The cooling air thus flows through the spaces between each liner ring and the corresponding wall of the barrier ring, between the rings 72 and 76, and then out through holes 74.

The combustion liner includes a slidable sleeve 82 mounted on the exterior of the wall portion 27 and 25 which is movable axially of the liner to control the flow of dilution air into the dilution zone 68 through a ring of ports 83 and 84. This sleeve is shown in its rearward or full air flow position bearing against stops 86. The sleeve 82 has ports 87 through it which overlie not only the ports 83 but also the barrier ring 26. These ports thus allow air flow into the barrier ring at all times.

If sleeve 82 is moved forwardly, the area of the ports 83 and 84 will be reduced to diminish dilution air flow, which ordinarily is accomplished by corresponding increase in primary air flow. Best control of the primary air to fuel ratio with least pressure drop is accomplished by varying both primary and secondary air flow areas. To move the sleeve 82, it is provided with circumferentially spaced brackets 88 to which are attached push-pull rods 90 (see FIG. 1). These push-pull rods extend through glands 91 in the combustion section cover 14 and are attached to a suitable yoke 92 by which the rods may be moved axially of the liner, thereby to move the sleeve 82.

This invention is not concerned with mechanization or control for the adjustment of the primary and secondary air ports by movement of valve member 38 and sleeve 82. Any suitable system may be adopted.

This brings us to the matter of control of air flow through centerbody 32 inside the primary air swirlers. The downstream end of the centerbody 32 converges to an outlet directed toward the center of throat 22. This outlet may be closed by a valve plug or stopper 102 which is movable axially forward from the position illustrated in FIG. 4 where it closes the air passage. Plug 102 is fixed to a reciprocable tube 103 which is guided in a sleeve 104 supported from the wall of centerbody 32 by circumferentially spaced radial plates 106. Tube 103 extends through the cover 14 in which it is supported by a gland 107 for sliding movement and for minimizing leakage. The outer end of tube 103 extends into an expansible chamber or diaphragm type motor 108 having a casing 109 supported by legs 110 from the cover 14. Motor 108 acts to open the air inlet 34 under certain conditions.

Figure 2:
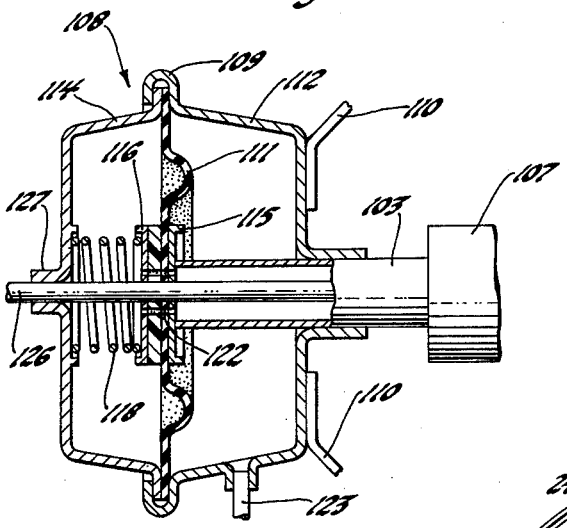
FIG. 2 is an axial sectional view of an air valve controlling expansible chamber motor arrangement.

Motor 108 and the arrangement for supplying fuel to the combustion chamber are illustrated primarily on FIG. 2. Tube 103, which is connected to plug 102, also is fixed to a diaphragm 111 in the expansible chamber motor 108. This motor may have a housing composed of two bowl-shaped sections 112 and 114. Section 112 is fixed to the supporting legs 110 and may be crimped around the margin of section 114, with the diaphragm 111 clamped between the two sections. Tube 103 may be fixed to a disk 115 on one side of the diaphragm which in turn is fixed to a spring abutment disk 116 on the other side of the diaphragm by rivets or the like (not illustrated). A compression spring 118 is mounted between the inner surface of housing section 114 and the abutment 116. Spring 118 thus pushes on rod 103 to hold the valve plug in the closed position. The air pressure within the combustion apparatus also biases the plug toward closed position, the air being admitted to the interior of tube 103 through a port 119 in the tube and from the tube through one or more apertures 122 in diaphragm 111 to the space to the left of diaphragm 111 as shown in FIG. 2.

The force tending to open the air passage 34 is exerted against the right face of the diaphragm as illustrated by the pressure of the main fuel supplied to the combustion chamber. Particularly, in this embodiment, fuel line 58 has a branch 123 which enters the casing section 112. The excess of fuel pressure over air pressure in normal operation of the combustion apparatus overcomes spring 118 and pushes the diaphragm to the left as viewed in the figures, drawing plug 102 into the centerbody and opening the passage for flow of air through the opening 34. This provides a non-swirling jet of air directed to the center of the throat 22 which impinges upon and reverses the flow of recirculating combustion products flowing upstream along the axis of the combustion chamber in the reaction zone 66.

For deceleration of the engine, the fuel is cut back, fuel pressure decreases, and the air pressure becomes higher relative to the fuel pressure. The air pressure and force of spring 118 overcome the fuel pressure to seat plug 102 and cut off this non-swirling air. The result is that the recirculating combustion products can flow into the throat 22 to promote evaporation of the fuel and to stabilize combustion, eliminating the likelihood of flameout upon cutback of fuel.

A pilot fuel spray nozzle 124 is threaded into the downstream face of plug 102. This nozzle is supplied through a fuel tube 126 extending coaxially through the tube 103 fixed to the plug 102, which defines a passage into the pilot fuel spray nozzle. Tube 126 extends to an appropriate place for a flexible connection for supply of pilot fuel. As illustrated, tube 126 extends through the diaphragm 111 and through a closely fitting boss 127 of the motor 108.

Flow of fuel to the pilot fuel injector 124, the air-blast fuel injector line 58, and the wall-film fuel injector line 60 may be suitably controlled by fuel control mechanism which is immaterial to the present invention and will not be described.

This completes the description of the structure of the preferred embodiment of the combustion apparatus. Presumably, the operation will be clear from what has been set out above, but it may be desirable to review the operation briefly.

Normally, fuel is supplied to the air-blast fuel injector through wall 30 and to the pilot fuel injector 124, although the latter may be turned off during operation of the combustor. Additional fuel may be supplied to the wall-film fuel injection means 64. This may be employed instead of the air-blast injector in some cases.

When using the preferred air-blast fuel injector, the air is picked off the inside of the wall of ring 51 by the air entering through the swirler vanes 36 and carried toward the throat 22. At the downstream edge of the intermediate wall this air encounters the more rapidly swirling air flowing through vanes 35. The resulting shear generates turbulence downstream and the swirling air-fuel mixture flows into and through the throat 22. The fuel evaporates in the relatively hot compressed air, particularly under regenerative cycle inlet temperature conditions.

A rather considerable degree of swirl is required to produce the internal recirculation in the reaction zone needed for low emission combustion and flame stabilization. This is provided for by the converging-diverging venturi type section. The lower degree of swirl in the intermediate air inlet will aid in prevention of undesirable upstream penetration of recirculation from the reaction zone into the vaporization zone. It also protects the fuel spray from being penetrated by the recirculating gases. Also, the non-swirling air admitted under most conditions through the entrance 34 aids in preventing such undesirable forward penetration of recirculating combustion gases.

The function of the air entering through holes 65 in mixing the partially stratified fuel-air mixture emerging from the throat, in preventing propagation of flame forwardly through the boundary layer along the wall, and in acting as an aerodynamic flameholder has been mentioned.

The sudden expansion at the ring 24 as the burning fuel-air mixture proceeds downstream leads to stabilization of the flame and reduces heating of the wall rings 24 and 25.

The barrier 26 provides an orifice between the reaction and dilution zones of about half the area of the zones themselves. This accelerates the flow from the reaction zone to the dilution zone and provides an aerodynamic barrier against penetration of the dilution air entering through opening 83 and 84 into the core of the reaction zone.

It should be apparent to those skilled in the art from the preceding detailed description that the combustion apparatus according to the invention involves various novel structural features to provide better control of combustion and cleaner exhaust.

The detailed description of the preferred embodiment of the invention for the purpose of explaining the principles thereof is not to be considered as limiting or restricting the invention, since many modifications may be made by the exercise of skill in the art.

We claim:

1. A combustion apparatus comprising, in combination, a housing providing a conduit for compressed air and a combustion liner in the housing, the liner being defined by liner wall means extending from an upstream end providing an inlet for combustion air to a downstream end providing an outlet for combustion products; the liner defining, in flow sequence from the upstream to the downstream end, a fuel introduction zone, a reaction zone, and a dilution zone, in which the improvement comprises the combination of a convergent-divergent portion of the wall means defining a throat between the fuel introduction zone and the reaction zone; a centerbody on the axis of the liner upstream of the throat defining with the upstream end of the liner wall a combustion air inlet; a swirler in the said air inlet; means for supplying fuel into the said inlet for carburetion of the entering air; the centerbody defining a passage for additional non-swirling air from the conduit directed toward the said throat; and means operative to open and close the said passage, the last-named means including means to close the passage only at low rates of fuel introduction.

2. A combustion apparatus comprising, in combination, a housing providing a conduit for compressed air and a combustion liner in the housing, the liner being defined by liner wall means extending from an upstream end providing an inlet for combustion air to a downstream end providing an outlet for combustion products; the liner defining, in flow sequence from the upstream to the downstream end, a fuel introduction zone, a reaction zone, and a dilution zone, in which the improvement comprises the combination of a convergent-divergent portion of the wall means defining a throat between the fuel introduction zone and the reaction zone; a centerbody on the axis of the liner upstream of the throat defining with the upstream end of the liner wall a combustion air inlet; a swirler in the said air inlet; means for supplying fuel into the said inlet for carburetion of the entering air; the centerbody defining a passage for additional non-swirling air from the conduit directed toward the said throat; and means responsive to the pressures of combustion air and fuel effective to open and close the said passage, the last-named means opening the passage in response to a increase in the pressure difference between the fuel and air.

3. A combustion apparatus comprising, in combination, a housing providing a conduit for compressed air and a combustion liner in the housing, the liner being defined by liner wall means extending from an upstream end providing an inlet for combustion air to a downstream end providing an outlet for combustion products; the liner defining, in flow sequence from the upstream to the downstream end, a fuel introduction zone, a reaction zone, and a dilution zone, in which the improvement comprises the combination of a convergent-divergent portion of the wall means defining a throat between the fuel introduction zone and the reaction zone; a centerbody on the axis of the liner upstream of the throat; intermediate wall means disposed intermediate the centerbody and the liner wall means dividing the combustion air inlet into two concentric annular portions; a swirler in each portion of the air inlet; means for supplying fuel to one of said wall means for carburetion of the entering air; the centerbody defining a passage for additional non-swirling air from the conduit directed toward the said throat; and means responsive to the pressures of combustion air and fuel effective to open and close the said passage, the last-named means opening the passage in response to a increase in the pressure difference between the fuel and air.

4. A combustion apparatus comprising, in combination, a housing providing a conduit for compressed air and a combustion liner in the housing, the liner being defined by liner wall means extending from an upstream end providing an inlet for combustion air to a downstream end providing an outlet for combustion products; the liner defining, in flow sequence from the upstream to the downstream end, a fuel introduction zone, a reaction zone, and a dilution zone, in which the improvement comprises the combination of a convergent-divergent portion of the wall means defining a throat between the fuel introduction zone and the reaction zone; a centerbody on the axis of the liner upstream of the throat; intermediate wall means disposed intermediate the centerbody and the liner wall means dividing the combustion air inlet into two concentric annular portions; a swirler in each portion of the air inlet, the swirlers being adapted to cause different degrees of swirl to the air entering through the respective portions of the air inlet; means for supplying fuel to said intermediate wall means for carburetion of the entering air; the centerbody defining a passage for additional non-swirling air from the conduit directed toward the said throat; and means responsive to the pressures of combustion air and fuel effective to open and close the said passage, the last-named means opening the passage in response to a increase in the pressure difference between the fuel and air.

* * * * *

UNITED STATES PATENT AND TRADEMARK OFFICE

CERTIFICATE OF CORRECTION

PATENT NO. : 3,958,416

DATED : May 25, 1976

INVENTOR(S) : Dean C. Hammond, Jr. et al

It is certified that error appears in the above–identified patent and that said Letters Patent are hereby corrected as shown below:

Column 5, line 25 "accomplished" should be --accompanied--.

Signed and Sealed this

Thirty-first Day of August 1976

[SEAL]

*Attest:*

RUTH C. MASON
*Attesting Officer*

C. MARSHALL DANN
*Commissioner of Patents and Trademarks*